United States Patent [19]

Dubeck

[11] 3,994,720

[45] Nov. 30, 1976

[54] METALS EXTRACTION PROCESS

[75] Inventor: Michael Dubeck, Birmingham, Mich.

[73] Assignee: Ethyl Corporation, Richmond, Va.

[22] Filed: Mar. 28, 1975

[21] Appl. No.: 562,903

Related U.S. Application Data

[63] Continuation-in-part of Ser. No. 396,764, Sept. 13, 1973, abandoned.

[52] U.S. Cl. ..... 75/103; 75/101 R; 75/117; 75/119; 75/121; 75/21; 423/150; 423/32; 423/56

[51] Int. Cl.[2] ..... C22B 1/02; C22B 15/10; C22B 23/04; C22B 47/00

[58] Field of Search ..... 75/101 R, 103, 117, 75/119, 121, 21, 108, .5 AA, .5 BA; 423/150, 151, 152

[56] References Cited

UNITED STATES PATENTS

| | | | |
|---|---|---|---|
| 2,662,009 | 12/1953 | Roberts et al. | 75/108 |
| 3,369,886 | 2/1968 | Metzger et al. | 75/.5 A |
| 3,734,715 | 5/1973 | Redman | 75/21 |

OTHER PUBLICATIONS

*Chemical Abstracts*, vol. 67, 1967, p. 102052.

*Primary Examiner*—G. Ozaki
*Attorney, Agent, or Firm*—Donald L. Johnson; John F. Sieberth; Robert A. Linn

[57] ABSTRACT

A process is disclosed for extracting nickel, copper, cobalt and molybdenum from a complex ore containing copper, nickel, cobalt, molybdenum, manganese and iron. The process features treatment of the ore with alcohol, aldehyde or mixtures thereof followed by leaching with an aqueous solution of ammonia and ammonium salt. A specific complex ore is sea nodules.

5 Claims, No Drawings

METALS EXTRACTION PROCESS

Cross Reference to Related Application

This application is a Continuation-in-Part of copending application Ser. No. 396,764, filed Sept. 13, 1973, and subsequently abandoned.

BACKGROUND OF THE INVENTION

The subject matter of the present invention is the recovery of metal values from a complex ore. The recovery comprises an ore pretreatment and leaching sequence.

Complex ores containing large amounts of manganese and lesser amounts of iron, nickel, copper, cobalt, molybdenum and other metals are found as loose deposits in various locations on the ocean floor. These loose deposits are commonly referred to as sea nodules, manganese nodules, ocean nodules, manganese sea nodules, etc. Methods for recovering metals from these nodules are described, e.g., in U.S. Pat. Nos. 3,723,095; 3,728,105; 3,734,715; and South African Pat. No. 71/04584.

A novel process has been discovered for extracting Cu, Ni, Co and Mo from these complex ores. The process utilizes pretreatment of the ore with alcohol, aldehyde or a mixture of alcohol and aldehyde.

SUMMARY OF THE INVENTION

A process for recovering nickel, copper, cobalt and molybdenum from a complex ore containing manganese, iron, copper, nickel, cobalt and molybdenum by treating comminuted ore with alcohol, aldehyde or a mixture of alcohol and aldehyde at elevated temperatures and subsequently leaching the treated ore with an aqueous solution containing ammonia and ammonium salt.

DESCRIPTION OF THE PREFERRED EMBODIMENTS

An embodiment of the present invention is a process for recovering copper, nickel, cobalt and molybdenum from sea nodules containing copper, nickel, cobalt, molybdenum, manganese and iron, which comprises 1. treating comminuted ore with gaseous organic compound selected from the group consisting of alcohols, aldehydes and mixtures thereof at temperatures above about 200° C.,
2. leaching said treated ore with aqueous solution containing ammonia and ammonium salt,
3. separating any insoluble material which remains after said leaching whereby a solution containing soluble copper, nickel, cobalt and molybdenum, substantially free of manganese and iron is obtained.

While the comminuted ore is being heated to treatment temperature, it may be swept with an inert gas. This sweep gas can also be used to carry the organic treating compound over the heated ore.

The native complex ore or sea nodules vary some both in physical characteristics and chemical composition depending on the region the nodules are obtained. A detailed chemical analysis of nodules from the Pacific Ocean is given on pages 449–450, *The Encyclopedia of Oceanography*, R. W. Fairbridge, Reinhold Publishing Corp., N.Y. (1966) and in U.S. Pat. No. 3,169,856. Generally, these nodules can contain up to about 40 per cent manganese, up to about 25 per cent of iron, less than about 2 per cent copper, less than about 2 per cent nickel, less than about 1 per cent cobalt, less than about 0.1 per cent molybdenum, and lesser amounts of other metals and minerals. Generally, these sea nodules are substantially free of sulfidic sulfur.

The sea nodules are generally spherical in shape and range in diameter from about 1 to about 4 inches. Prior to being used in the present process, these nodules are ground to about 25 mesh or less, and preferably about 125 mesh or less.

The organic compounds with which the comminuted complex ore is treated, are alcohols, aldehydes and mixtures thereof. Preferred alcohols are monohydroxy alkanols having up to 4 carbon atoms. Methanol is a most preferred alcohol. Preferred aldehydes are alkanals having up to 4 carbon atoms. Formaldehyde or paraformaldehyde are most preferred aldehydes. Mixtures of alcohols and aldehydes can also be used. The mixture of methanol and formaldehyde is preferred.

The treatment with organic compound is carried out at temperatures above about 200° C. Treatment temperatures in the 200°–400° C. range are preferred with 200°–300° C. range more preferred, with 250°–300° C. range being most preferred. The treatment of the heated ore with the organic compound is exothermic — and this permits heating of the ore to a lower initial temperature. Thus, for example, if the desired treatment temperature is 225° C. the comminuted nodules need only be preheated to a temperature lower than 225° C., e.g., 200° C. — the exotherm from treatment with the organic compound supplying the additional heat to reach the desired treatment temperature.

Treatment with the organic compound can be carried out at atmospheric pressure or pressure above atmospheric, e.g., 15 p.s.i.g., 50 p.s.i.g., 150 p.s.i.g., 500 p.s.i.g., 1500 p.s.i.g. or higher.

Any conventional method of preheating of the comminuted complex ore to treatment temperature can be used. A gaseous sweep may be used while preheating. This gaseous sweep can be any suitable gaseous material which does not adversely affect the comminuted complex ore, its treatment with alcohol, aldehyde or mixtures thereof or its subsequent leachability with the solution of ammonia and ammonium salt. A gaseous stream of alcohol, aldehyde or alcohol and aldehyde mixture may be used during this preheating — or, other gas sweep can be used. Examples of useful sweep gases are $N_2$, CO, Ar, $CO_2$, synthesis gas and the like. During the preheating, a substantial amount of any water present in the comminuted ore is driven out. The amount of organic compound used for the treatment at treatment temperature can be varied. Generally sufficient organic compound is used to provide a molar ratio of Mn (contained in the ore):organic compound of up to 1:1. Mn:organic compound ratios of 1:0.5 to 1:0.75 are preferred. The treatment time will vary being dependent on the other factors such as particle size, the complex ore, the organic compound used, the flow rate of the organic compound, the temperature, etc.

The organic compound treated ore is subsequently leached using an aqueous solution containing ammonia and an ammonium salt. Useful ammonium salts are exemplified by ammonium sulfate, ammonium halide, e.g., chloride, bromide or iodide, ammonium carbonate, and the like. The concentration of ammonia in the solution can vary from 5 to 25% by weight — the ammonium salt concentration can vary from 2 to 20% by weight.

The leaching step is generally carried out at elevated temperatures, up to about 150° C. A preferred leaching temperature is about 100° C. Ordinarily, this leaching is carried out in a closed vessel to prevent loss of ammonia and $CO_2$ when the ammonium salt is ammonium carbonate. The leaching, like the organic compound treatment, can be carried out at atmospheric pressure as well as pressures above atmospheric.

The following general procedure was used to carry out a series of examples illustrating the process of the present invention.

GENERAL PROCEDURE

Ten grams of sea nodules, ground to less than 150 mesh, are charged to the treatment tube arranged vertically, fitted with a heating mantle and a gas inlet at the tube's lower end and a gas outlet at the upper end. The section of the gas inlet adjacent to the treatment tube is also provided with a heater. The sea nodule charge is heated to the treatment temperature with nitrogen gas sweep (30 ml/min). When the treatment temperature is reached, the organic compound is slowly introduced into the nitrogen sweep stream, at the heated section of the gas inlet. The rate of addition of the organic compound is adjusted to be continuous over a period of about one hour. After the organic compound addition is completed, the heating is discontinued and the treated charge is allowed to cool at 25° C. under nitrogen sweep.

The cooled treated charge is then directly transferred to a pressure vessel which contains 100 ml of the leaching solution containing 100 g/l $NH_3$ and 100 g/l of $(NH_4)_2CO_3$. The vessel is then sealed, heated to 100° C. and stirred for one hour. The vessel is then cooled, the leached mixture is filtered and the filtrate is analyzed by atomic absorption for soluble metal content.

Following is a tabulation of data for the aforesaid series of Examples.

TABLE

METALS RECOVERY FROM SEA NODULES(1)

| | Organic Treatent Step | | | | Leaching | | % Metals Extracted | | | |
|---|---|---|---|---|---|---|---|---|---|---|
| Ex. | Compound | Amount(2) | Temperature (° C) | Time (Hrs) | Solution | Temp. (° C) | Ni | Cu | Co | Mn |
| 1 | None | — | 240 | 1.0(3) | A(4) | 50 | 0.3 | 3 | — | — |
| 2 | $CH_3OH$ | 3.5 | 270 | 3.5 | A | 50 | 77 | 82 | 32 | — |
| 3 | $CH_3OH$ | 2.5 | 310 | 2.5 | A | 100 | 93 | 88 | 35 | — |
| 4 | $CH_3OH$ | 0.7 | 300 | 1.0 | A | 100 | 85 | 75 | 26 | — |
| 5 | $CH_3OH$ | 0.58 | 320 | 1.25 | A | 100 | 83 | 90 | 24 | — |
| 6 | $H_2C{=}O$ | 0.74 | 300 | 1.0 | A | 100 | 80 | 85 | 28 | — |
| 7 | $H_2C{=}O$ | 1.0 | 370 | 1.0 | A | 100 | 61 | 76 | 23 | — |
| 8 | $H_2C{=}O$ | 1.0 | 320 | 1.0 | A | 100 | 62 | 74 | 23 | — |
| 9 | $H_2C{=}O$ | 1.0 | 200 | 1.25 | A | 100 | 43 | 56 | 12 | 0.77 |
| 10 | $CH_3OH$ | 1.0 | 200 | 1.0 | A | 100 | 33 | 46 | 6 | 0.04 |

(1)Sea nodules analysis: Ni = 0.889%; Cu = 0.708%; Co = 0.196%; Fe = 5.73%; Mn = 20.67%.
(2)Moles of organic compound per mole of Mn in the ore charge.
(3)Under $N_2$ sweep.
(4)100 g $NH_3$/liter + 100 g $(NH_4)_2CO_3$/liter.

From the data in the Table, it is clear that treatment of the comminuted sea nodules with $CH_3OH$ or $H_2C{=}O$ permits ammoniacal leaching of a substantial amount of the nickel and copper and some cobalt. The control, Example 1, shows that ammoniacal leaching, after treatment of the ground nodules with only $N_2$ at 240° C. for one hour, is ineffective for extracting metals. Molybdenum is also found in the leach solution along with the nickel, copper and cobalt extracted. Ethanol used in place of methanol effects analogous results.

Claims to the invention follow.

I claim:

1. In the process of recovering from sea nodules a copper, nickel, cobalt and molybdenum concentrate with diminished iron and manganese content by subjecting comminuted nodules to a high temperature gas treatment to increase the leachability of the metals to be concentrated, and then leaching the thus-treated material with an aqueous solution of ammonia and ammonium salt, the improvement according to which the gas treatment is with a lower alkanol or lower alkanal or a mixture thereof, and is effected at a temperature below 400° C.

2. The combination of claim 1 in which the gas treatment temperature is between about 250° and about 300° C.

3. The combination of claim 1 in which the gas treatment is with formaldehyde.

4. The combination of claim 1 in which the gas treatment is with methanol.

5. The combination of claim 1 in which the leaching is effected at about 100° C.

* * * * *